US005786577A

United States Patent [19]

Han et al.

[11] Patent Number: 5,786,577

[45] Date of Patent: Jul. 28, 1998

[54] MICROWAVE OVEN HAVING A STEAM GENERATOR FOR KEEPING FOOD MOIST DURING COOKING

[75] Inventors: Yong-Woon Han, Kunpo; Dae-Sung Han, Suwon, both of Rep. of Korea

[73] Assignee: Samsung Electronics Co., Ltd., Suwon, Rep. of Korea

[21] Appl. No.: 677,559

[22] Filed: Jul. 8, 1996

[30] Foreign Application Priority Data

Jul. 10, 1995 [KR] Rep. of Korea ..... 95-20212

[51] Int. Cl.[6] ..... H05B 6/80; H05B 6/54

[52] U.S. Cl. ..... 219/682; 219/772

[58] Field of Search ..... 219/682, 687, 219/688, 772, 401

[56] References Cited

U.S. PATENT DOCUMENTS

| | | | |
|---|---|---|---|
| 4,449,026 | 5/1984 | Satoh | 219/682 |
| 4,454,404 | 6/1984 | Zushi | 219/682 |
| 4,692,581 | 9/1987 | Mizutani et al. | 219/772 |
| 5,520,099 | 5/1996 | Chung | 219/731 |
| 5,523,550 | 6/1996 | Kimura | 219/772 |
| 5,525,782 | 6/1996 | Yoneno et al. | 219/682 |

FOREIGN PATENT DOCUMENTS

| | | |
|---|---|---|
| 60-41704 | 3/1985 | Japan . |
| 62-6017 | 12/1987 | Japan . |

*Primary Examiner*—Philip H. Leung

*Attorney, Agent, or Firm*—Burns, Doane, Swecker & Mathis, L.L.P.

[57] ABSTRACT

A microwave oven includes a cooking chamber and a steam generator for supplying steam thereto for preventing food from drying out during cooking. The steam generator includes a water storage tank and a pair of spaced-apart electrodes mounted in the tank for producing an electrical current across the water in the tank, thereby heating the water to form steam. The water may contain an electrical conducting substance such as sodium chloride to facilitate generation of the electrical current.

8 Claims, 3 Drawing Sheets

MICROWAVE OVEN HAVING A STEAM GENERATOR FOR KEEPING FOOD MOIST DURING COOKING

BACKGROUND OF THE INVENTION

1. FIELD OF THE INVENTION

The present invention relates to a microwave oven for executing a cooking performance by way of a magnetron and steam, and more particularly to a microwave oven for applying team to food during a dielectric heating according to a high frequency oscillation so that a drying phenomenon caused by moisture evaporating from the food can be prevented.

2. DESCRIPTION OF THE PRIOR ART

As a prior art, there is disclosed a Japanese laid open patent publication No. showa 62-60617 (published date of Dec. 7, 1987). A microwave oven disclosed in the Japanese Patent publication No. Showa 62-60617 is constituted, as illustrated in FIG. 1, by a heating chamber A, a high frequency oscillator 1 for dielectrically heating food in the heating chamber A, a senser for detecting humidity or gas density changing according to the dielectric heating of the food by way of the high frequency oscillator 1 and a heater coil 3 for overall heating of the food, whereby the sensor 2 is disposed near the heater 3 in order to receive radiant heat from the heater 3.

However, there is a problem in the conventional microwave oven thus constructed, in that a drying phenomenon caused by evaporation of moisture from the food during cooking prevents the taste and cooked condition of the food from being maintained in good state (by way of example, the surface of the food become hardened). frequency oscillator 1 and the heater 3 are mounted therein to cook the food accomodated in the heating chamber A by way of dielectric heating and electric heating according to operations also electric consumption is inevitably increased due to large capacity caused by use of the heater 3 and a safety apparatus should be provided due to the generation of high temperature to thereby make construction thereof complicated.

Meanwhile, Japanese laid open utility model publication No. Showa 60-41704 (published on Mar. 25, 1996) disclosed a microwave oven with the afore-mentioned problems taken into account.

The microwave oven disclosed in the Japanese laid open utility model publication No. Showa 60-41704 performs a steam function as illustrated in FIG. 2, where water (W) is boiled by the heat emitted from heaters 4 to generate steam (S) from a predetermined quantity of water (W) in a boiler 5. The steam (S) is supplied to an interior of a heating chamber (A) through a passage (C) connected to an upper portion of the boiler 5 and to thereby help maintain moisture in the food.

Furthermore, residual water not steamed in the boiler 5 is drained downwards by an opening operation of a valve 6 disposed under the boiler 5 and simultaneously is retrieved by a drainage bucket 7 releasably provided under the microwave oven.

Dew liquified by not being absorbed into the food when excessive steam (S) is supplied into the heating chamber (A) is collected at a floor of the heating chamber (A) and is simultaneously drained into the drainage bucket 7 to thereafter be retrieved.

However, there is a problem with that microwave oven in that only water (W) can be placed in the boiler 5 which take a long time to generate steam (S) and increases electric consumption due to use of a large capacity of heater 4.

SUMMARY OF THE INVENTION

Accordingly, the present invention is disclosed to solve the aforementioned problems and it is an object of the present invention to provide a microwave oven with which a drying phenomenon caused by an evaporation of moisture from the food can be prevented by a periodic supply of steam in the course of dielectric heating of the food to help maintain a good taste and an original cooked state of the food.

It is another object of the present invention to provide a microwave oven in which a small capacity steam generator can be installed to minimize consumed electric energy.

It is still another object of the present invention to provide a microwave oven whose structure can be simplified because no separate safety apparatus is needed to be mounted thereto.

In accordance with the objects of the present invention, there is provided a microwave oven employing a steam generator for supplying steam to the food, comprising:

- a waveguide formed at an upper side of a cooking chamber;
- a high frequency generating apparatus for being disposed at a side of the waveguide so as to generate high frequency waves into the waveguide;
- a steam generating apparatus having a water tank disposed at an inner side of the microwave oven for storing water and a pair of first and second electrode plates disposed at an inner side of the water tank at a predetermined interval; and
- a power supply apparatus for supplying electric power to the steam generating apparatus.

BRIEF DESCRIPTION OF THE DRAWINGS

For a fuller understanding of the nature and objects of the invention, reference should be made to the following detailed description taken in conjunction with the accompanying drawings in which.

DETAILED DESCRIPTION OF PREFERRED EMBODIMENT OF THE INVENTION

Embodiments of the present invention will now be described in detail with reference to accompanying drawings.

Figure 1:
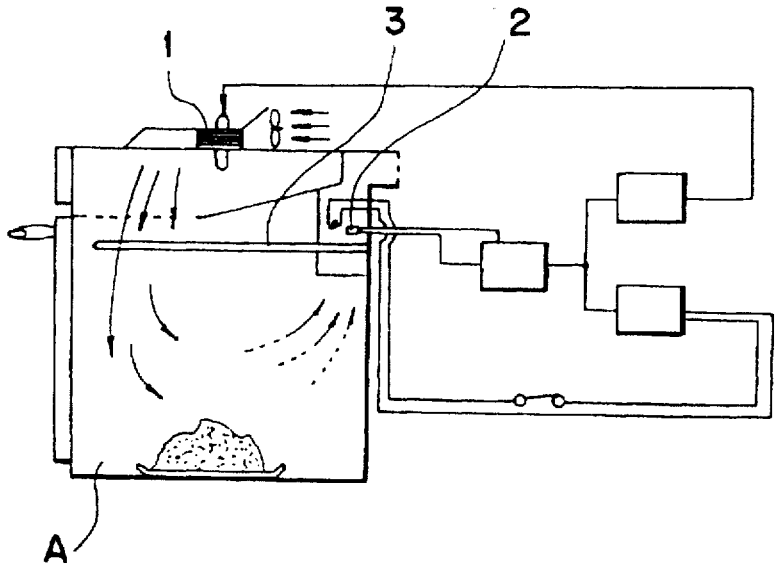
FIG. 1 (PRIOR ART)
FIG. 1 is a sectional view for schematically illustrating a microwave oven using a heater and a high frequency oscillator according to the prior art.
Figure 2:
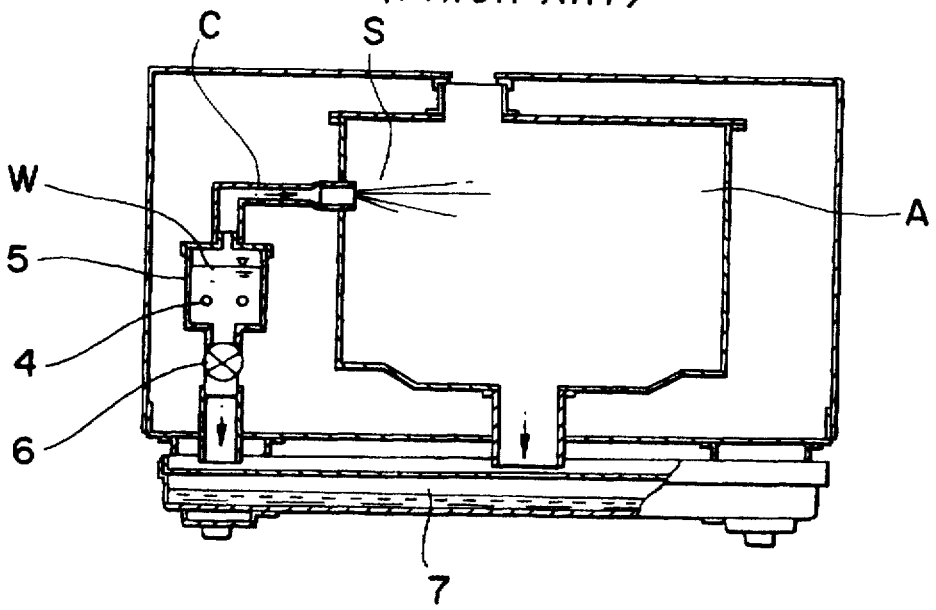
FIG. 2 (PRIOR ART)
FIG. 2 is another prior art sectional view for schematically illustrating a microwave oven utilizing a steam generator.
Figure 3:
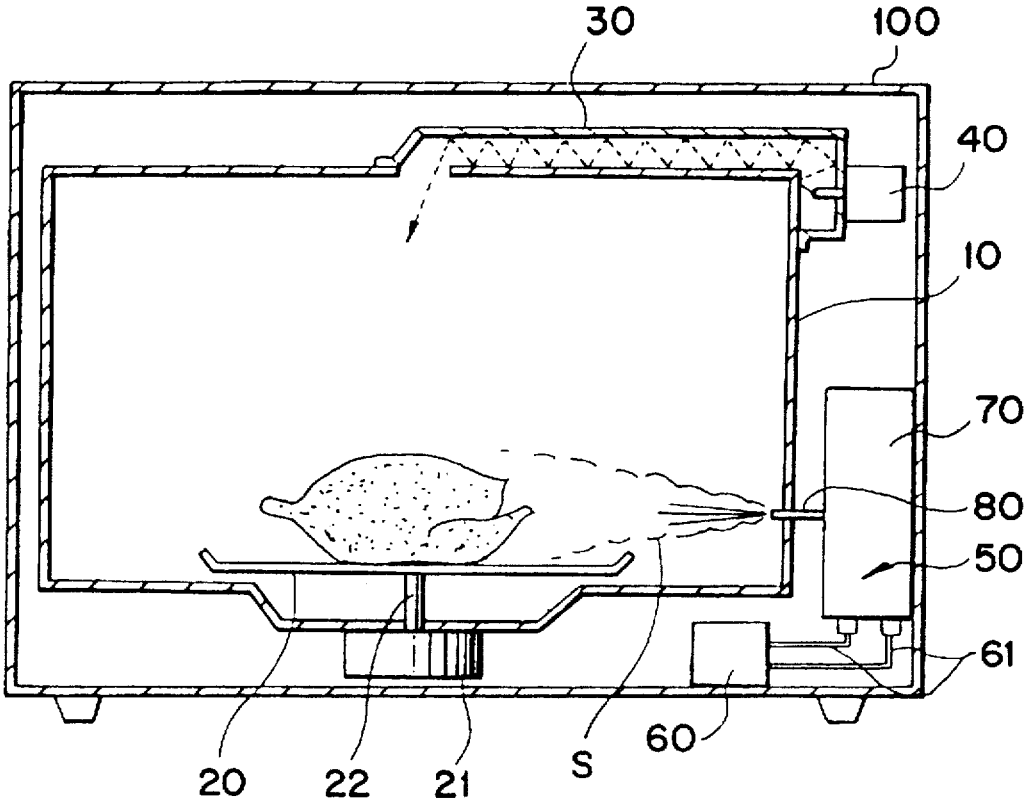
FIG. 3 is a sectional view for schematically illustrating a microwave oven utilizing a steam generator according to the present invention.

The microwave oven according to the present invention includes, as illustrated in FIG. 3, a cooking chamber 10 formed with an opening toward a front surface thereof, a turn table 20 for being disposed on a floor of the cooking chamber 10 so as to accommodate the food and to rotate same, a high frequency oscillator 40 for being so disposed at one side of the cooking chamber 10 that high frequency waves generated by oscillation of a magnetron can be supplied into the cooking chamber 10 through the medium of a waveguide 30 to thereby heat the food on the turn table 20 dielectrically, a steam generator 50 for supplying steam to the surface of the food so as to prevent a drying phenomenon caused by moisture evaporation from the food during the dielectrical heating, and a power supply apparatus 60 for supplying electric power to the turn table 20, high frequency oscillator 40 and the steam generator 50.

Figure 4:
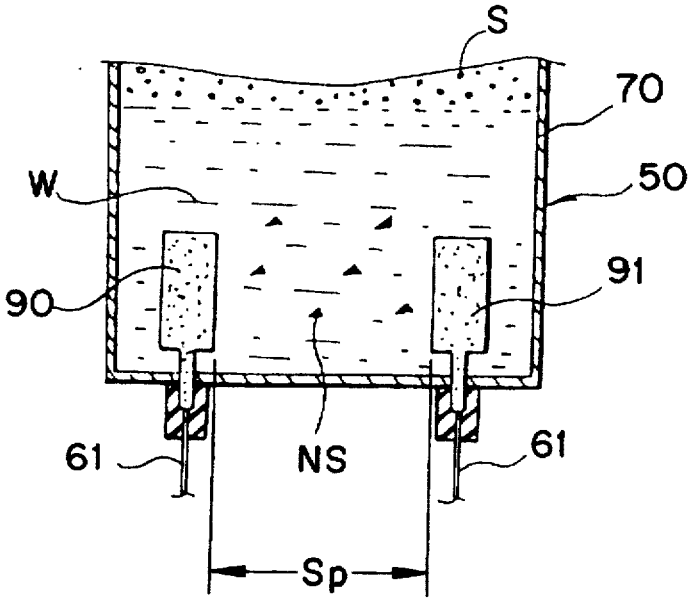
FIG. 4 is a sectional view for illustrating an interior of the steam generator as a principal part of the present invention.

The steam generator 50 includes, as illustrated in FIG. 4, a water tank 70 for storing the water (W), an injection nozzle 80 for injecting the steam (S) from the water tank 70 into the cooking chamber 10, and first and second electrode plates 90 and 91 for receiving power from the power supply apparatus 60 and disposed in the water tank 70 at a predetermined spacing sp with an opposite voltage therebetween so that the water (W) can be boiled by the resistance of the sodium chloride solution filled therebetween when a current is applied thereto.

The first and second electrode plates 90 and 91 are apparatuses adapted to boil the water (W) in a shortest possible period of time, and although a detailed description is not given on the drawing, the spacing therebetween is so designed as to be narrowed or increased according to use desired by a user.

Figure 5:
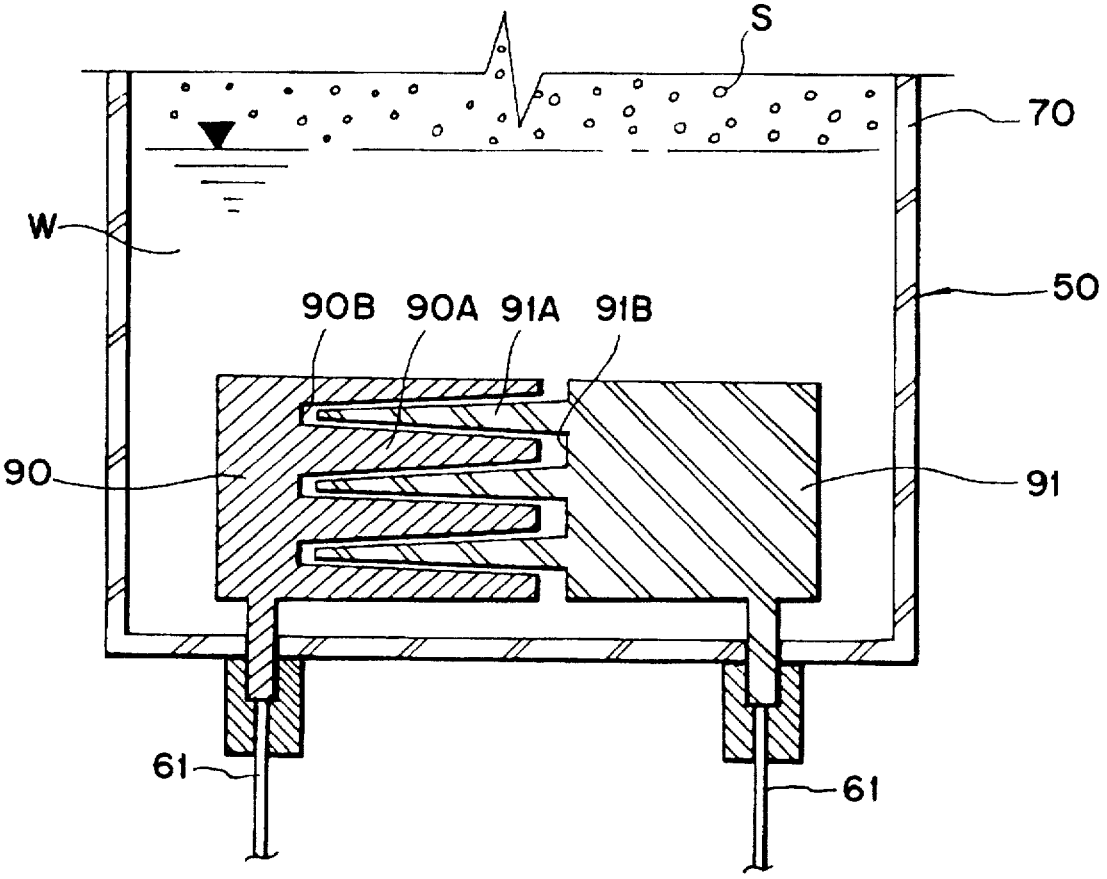
FIG. 5 is a sectional view for illustrating an interior of a steam generator according to another embodiment of the present invention.

Furthermore, the first and second electrode plates 90 and 91 can be meshed together by means of protrusions 90A, 91A and depressions 90B, 91B at a predetermined spacing as illustrated in FIG. 5.

At this time, it should be noted that an insertion into the water (W) of a predetermined quantity of electrically conductive solution such as sodium chloride solution (Ns) as an additive is not always needed because the first electrode plate 90 and the second electrode plate 91 are apparatuses for increasing a resistance value therebetween when the current flows therebetween.

Meanwhile, 1–2 grams of the sodium chloride solution as an electrically conductive solution should be mixed with 300 cc of water (W) when same is put into the water tank 70.

It is desirable that the first electrode plate 90 and the second electrode plate 91 should maintain a spacing sp of 20 mm–30 mm as illustrated in FIG. 4.

It should be noted that the electode plates 90 and 91 are coated by carbon substances.

Reference numeral 21 in the drawing defines a motor, 22 designates a motor axis, 61 designates a lead wire and reference numeral 100 designates a cavity.

Now, the operation of the microwave oven according to the present invention thus constructed and an effect thereof could be described.

First of all, the food is placed on the turn table 20 in the cooking chamber 10 and simultaneously the sodium chloride solution is put into the water (W) in the water tank 70 in a ratio of 1–2 grams to 300 cc of water.

Then, an electric power is applied to the microwave oven, and a pad provided at a control panel is pressed, to thereby cause the high frequency waves to be supplied into the cooking chamber 10 through the waveguide 30 according to oscillating operation of the high frequency oscillator 40, and at the same time, to cause the high frequency waves to be scanned over the food accommodated on the rotating turn table 20. The food is then dielectrically heated and cooked by a heat-emitting reaction resulted from frictional collision of particles.

Meanwhile, when a current is applied to the first and second electode plates 90 and 91 connected to the power source apparatus 60 through the lead wire 61, the current is caused to flow in the first and the second electrode plates 90 and 91 by an electrical resistance value of the water (W) and the sodium chloride solution across the space sp Simultaneously, the electrode plates serve to emit heat, thereby causing the-steam to be generated above the surface of the water.

At this time, the steam (S) is generated on the surface of the water (W) when the water is boiled, as illustrated in FIG. 4.

When the user ejects the steam (S) formed in the water tank 70 at intervals of a few seconds on an automatic or semiautomatic basis by way of the pad disposed on the control panel, the steam (S) is ejected evenly to the food on the turn table 20 through an injection nozzle 80 disposed at one side of the water tank 70, as illustrated in FIG. 3, so that humidity on the food can be maintained at a constant level.

When the steam (S) is injected, a fan motor (not shown) is temporarily stopped of its operation in order to prevent the steam (S) from being dispersed by convectional air pressure generated by the operation of the fan motor. In other words, the steam (S) is supplied to a predetermined position where the food is placed.

After the predetermined quantity of steam (S) is sprayed onto the food, the injection nozzle 80 is closed according to an electrical signal. The applied steam avoids a drying phenomenon of the food resulted from evaporation of the moisture during the dielectric heating and maintains a good taste and an original cooked state of the food.

In case the voltage used for the microwave oven is 220 V, it is desirable to put in 2 grams of sodium chloride solution per 300 CC of water as a mixing ratio to maintain an appropriate resistance value.

Meanwhile, when the current flow automatically terminates the water tank 70 runs out of the water (i.e., the electrical conducting medium) (W), the steam generator 50 inherently becomes inoperative without any special safety apparatus working thereto, so that there occurs no overheating or excessive high temperature therein.

As the microwave oven according to the present invention provides in a water tank a pair of a first and second electrode plates having mutually opposite voltages whereby a current applied to the electrode plates flows therebetween by way of a resistance value of the water and sodium chloride solution filled in the water tank, enabling the water to be boiled in a short time and steam generated when the water is boiled to be injected toward the food, so that a food-drying phenomenon ascribed to moisture evaporation during a dielelctric heating can be prevented to thereby ensure a good taste and an original cooked state of the food.

There is another advantage from the microwave oven accordoing to the present invention in that a small capacity steam generator using a low used voltage can be installed to reduce consumed electricity and no separate safety apparatus is necessary.

The foregoing description of the preferred embodiments has been presented for the purpose of illustration and description. It is not intended to limit the scope of this invention. Many modifications and variations are possible in light of the above teaching. It should be noted that the present invention can be applied to all kinds of apparatus within the scope of the above presentation.

What is claimed is:

1. A microwave oven, comprising:

a cooking chamber;

a high frequency generator for supplying high frequency waves to the cooking chamber; and a steam generator for introducing steam into the cooking chamber, comprising a water-storing tank, a source of electrical power, and a pair of spaced-apart electrode plates arranged to be immersed within water disposed in the tank, the electrode plates connected to the source of electrical power, the water defining a resistance for creating an electrical current flow across the water in the tank for heating the water and generating steam therefrom, the steam generator becoming inoperative as the current flow automatically terminating in response to the water-storing tank running out of water.

2. The microwave oven according to claim 1 wherein the electrode plates are coated with a carbonaceous substance.

3. The microwave oven according to claim 2 wherein the electrode plates are spaced apart by 20–30 mm.

4. The microwave oven according to claim 1 wherein the tank contains a solution of water and an electrically conductive substance.

5. The microwave oven according to claim 4 wherein the electrically conductive substance is sodium chloride mixed at a ratio of 1–2 grams per 300 cc water.

6. The microwave oven according to claim 1 wherein the tank includes a nozzle for injecting an adjustable flow of steam into the cooking chamber.

7. The microwave oven according to claim 1 further including a magnetron for generating high frequency waves, and a waveguide disposed at an upper side of the cooking chamber for guiding the high frequency waves.

8. The microwave oven according to claim 1 wherein the electrode plates include protrusions and depressions, respectively, that are meshed together with a prescribed spacing therebetween.

* * * * *